US008421833B2

(12) United States Patent
Maruyama

(10) Patent No.: US 8,421,833 B2
(45) Date of Patent: Apr. 16, 2013

(54) THERMAL PAPER ROLL, IMAGE FORMING DEVICE, IMAGE FORMING METHOD, AND PROGRAM

(75) Inventor: Masahide Maruyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/220,803

(22) Filed: Aug. 30, 2011

(65) Prior Publication Data

US 2012/0056966 A1 Mar. 8, 2012

(30) Foreign Application Priority Data

Sep. 2, 2010 (JP) ..... P2010-196648

(51) Int. Cl.
*B41J 15/02* (2006.01)

(52) U.S. Cl.
USPC ..... 347/221; 400/613

(58) Field of Classification Search ..... 347/221; 400/613
See application file for complete search history.

(56) References Cited

U.S. PATENT DOCUMENTS

| | | | | | |
|---|---|---|---|---|---|
| 5,326,182 | A * | 7/1994 | Hagstrom | ..... | 400/223 |
| 5,755,519 | A * | 5/1998 | Klinefelter | ..... | 400/249 |
| 6,676,312 | B2 * | 1/2004 | Richard | ..... | 400/242 |
| 6,755,583 | B1 * | 6/2004 | Maruyama | ..... | 400/613 |
| 7,059,788 | B2 * | 6/2006 | Pearl et al. | ..... | 400/242 |
| 2004/0151526 | A1 * | 8/2004 | Pearl et al. | ..... | 400/242 |
| 2006/0133879 | A1 * | 6/2006 | Mindler | ..... | 400/242 |
| 2009/0123207 | A1 * | 5/2009 | Mindler | ..... | 400/242 |

FOREIGN PATENT DOCUMENTS

| | | | |
|---|---|---|---|
| JP | 60-67185 | * | 4/1985 |
| JP | 07-267506 | * | 10/1995 |
| JP | 07-267507 | * | 10/1995 |
| JP | 2000-313558 | * | 11/2000 |
| JP | 2000-351509 | | 12/2000 |
| JP | 2001-180058 | * | 7/2001 |
| JP | 2005-96145 | * | 4/2005 |
| JP | 2007-216465 | * | 8/2007 |

* cited by examiner

*Primary Examiner* — Huan Tran
(74) *Attorney, Agent, or Firm* — Frommer Lawrence & Haug LLP; William S. Frommer; Ellen Marcie Emas

(57) ABSTRACT

A thermal paper roll includes a paper core, a thermal paper wound on the paper core, a flange attached to at least one end surface of the paper core, and a contacted surface formed on a plane intersecting a roll axis of the paper core at a side opposite to the paper core side of the flange in order to detect or identify a state of the thermal paper roll.

13 Claims, 18 Drawing Sheets

| | ROLL ROTATION STATE (ONE ROTATION COMPLETED?) | | ROLL LOADING STATE (LOADING COMPLETED?) | |
|---|---|---|---|---|
| | YES | NO | YES | NO |
| LOADING STATE DETECTION SENSOR | L | L | L | H |
| ROTATION STATE DETECTION SENSOR | L | H | H/L | H |

FIG. 12

| ROLL TYPE | ROLL TYPE DETECTION SENSOR 1 | ROLL TYPE DETECTION SENSOR 2 | LOADING STATE DETECTION SENSOR |
|---|---|---|---|
| 1 | L | L | L |
| 2 | L | H | L |
| 3 | H | L | L |
| 4 | H | H | L |

THERMAL PAPER ROLL, IMAGE FORMING DEVICE, IMAGE FORMING METHOD, AND PROGRAM

BACKGROUND

The present disclosure relates to a thermal paper roll, an image forming device, an image forming method, and a program.

In the related art, there is known a thermal printer which performs printing on a thermal paper. The thermal printer is loaded with a thermal paper roll in which the thermal paper is wound on a paper core. In the thermal printer, there are cases where it is necessary to detect or identify the state of the thermal paper roll in order to detect the remaining amount of the thermal paper roll, select the type of thermal paper, prevent an error in the loading direction, and the like.

For example, Japanese Unexamined Patent Application Publication No. 2000-351509 described below discloses a dye sublimation printer in which a rotation state of a printing paper roll is detected, and the remaining amount of the printing paper is detected. The printer is loaded with a printing paper roll in which printing paper is wound on a paper core. In the printing paper roll, a notch is formed at an end surface of the paper core. A lever which enters and exits the notch according to the rotation of the printing paper roll is provided in the printer. In the printer, the entering and exiting time interval of the lever which varies depending on the remaining amount of the printing paper, that is, the rotation state of the printing paper roll is detected, and thereby the remaining amount of the printing paper is detected.

SUMMARY

However, if the notch is formed at the paper core of the printing paper roll, there are problems in that an inexpensive configuration is difficult to implement since the process of the paper core is complicated, and it is difficult to wind the printing paper on the paper core. In addition, since the notch is formed at the end surface of the paper core, there is a problem in that it is necessary to provide a relatively complicated detection mechanism in the printer side in order to detect a rotation state of the printing paper roll. Further, there is a problem in that when manufacturing costs of inexpensive thermal paper rolls are considered, the same configuration as the printing paper roll for the dye sublimation printer may not be employed from the viewpoint of cost effectiveness.

It is desirable to provide a thermal paper roll, an image forming device, an image forming method, and a program, capable of detecting or identifying a state of a thermal paper roll in order to detect a remaining amount of the thermal paper roll, select the type of thermal paper, prevent an error in the loading direction, and the like, with a simple configuration.

According to an embodiment of the present disclosure, a thermal paper roll includes a paper core, a thermal paper wound on the paper core, a flange attached to at least one end surface of the paper core, and a contacted surface formed on a plane intersecting a roll axis of the paper core at a side opposite to the paper core side of the flange in order to detect or identify a state of the thermal paper roll.

The contacted surface may be formed as a convex surface or a concave surface for detecting a rotation state of the thermal paper roll.

The contacted surface may be formed as a convex surface or a concave surface for detecting a loading state of the thermal paper roll.

The contacted surface may be formed as a convex surface or a concave surface for detecting a roll type of the thermal paper roll.

The contacted surface is formed as a convex surface or a concave surface for identifying a loading direction of the thermal paper roll.

According to another embodiment of the present disclosure, there is provided an image forming device including a roll loading portion loaded with a thermal paper roll, a state detection portion detecting a state of a contacted surface provided in the thermal paper roll, and a control portion performing a predetermined control according to the state of the thermal paper roll detected via the contacted surface, wherein the thermal paper roll includes, a paper core, a thermal paper wound on the paper core, a flange attached to at least one end surface of the paper core, and the contacted surface formed on a plane intersecting a roll axis of the paper core at a side opposite to the paper core side of the flange in order to detect a state of the thermal paper roll.

The control portion may perform a predetermined control according to a rotation state of the thermal paper roll detected via the contacted surface.

The control portion may perform a predetermined control according to a loading state of the thermal paper roll detected via the contacted surface.

The control portion may perform a predetermined control according to a roll type of the thermal paper roll detected via the contacted surface.

The roll loading portion may be provided with a lateral surface accommodating portion which holds the thermal paper roll to rotate about the roll axis via the flange attached to both end surfaces of the paper core.

The flange may be attached to only one end surface of the paper core, and the roll loading portion may be provided with a paper core holding axis which is inserted into the other end surface of the paper core, in order to hold the thermal paper roll so as to rotate about the roll axis.

According to still another embodiment of the present disclosure, there is provided an image forming method including detecting a state of a contacted surface provided in a thermal paper roll having a paper core, thermal paper wound on the paper core, a flange attached to at least one end surface of the paper core, and, the contacted surface formed on a plane intersecting a roll axis of the paper core at a side opposite to the paper core side of the flange in order to detect a state of the thermal paper roll, and performing a predetermined control according to the state of the thermal paper roll detected via the contacted surface.

According to still another embodiment of the present disclosure, there is provided a program enabling a computer to execute the image forming method. Here, the program may be provided using a computer readable recording medium, or may be provided via communication devices.

As described above, it is possible to provide a thermal paper roll, an image forming device, an image forming method, and a program, capable of detecting or identifying a state of the thermal paper roll with a simple configuration.

BRIEF DESCRIPTION OF THE DRAWINGS

FIG. 12 is a diagram illustrating sensor signals from the loading state detection sensor and the roll type detection sensor.

DETAILED DESCRIPTION OF EMBODIMENTS

Figure 1:
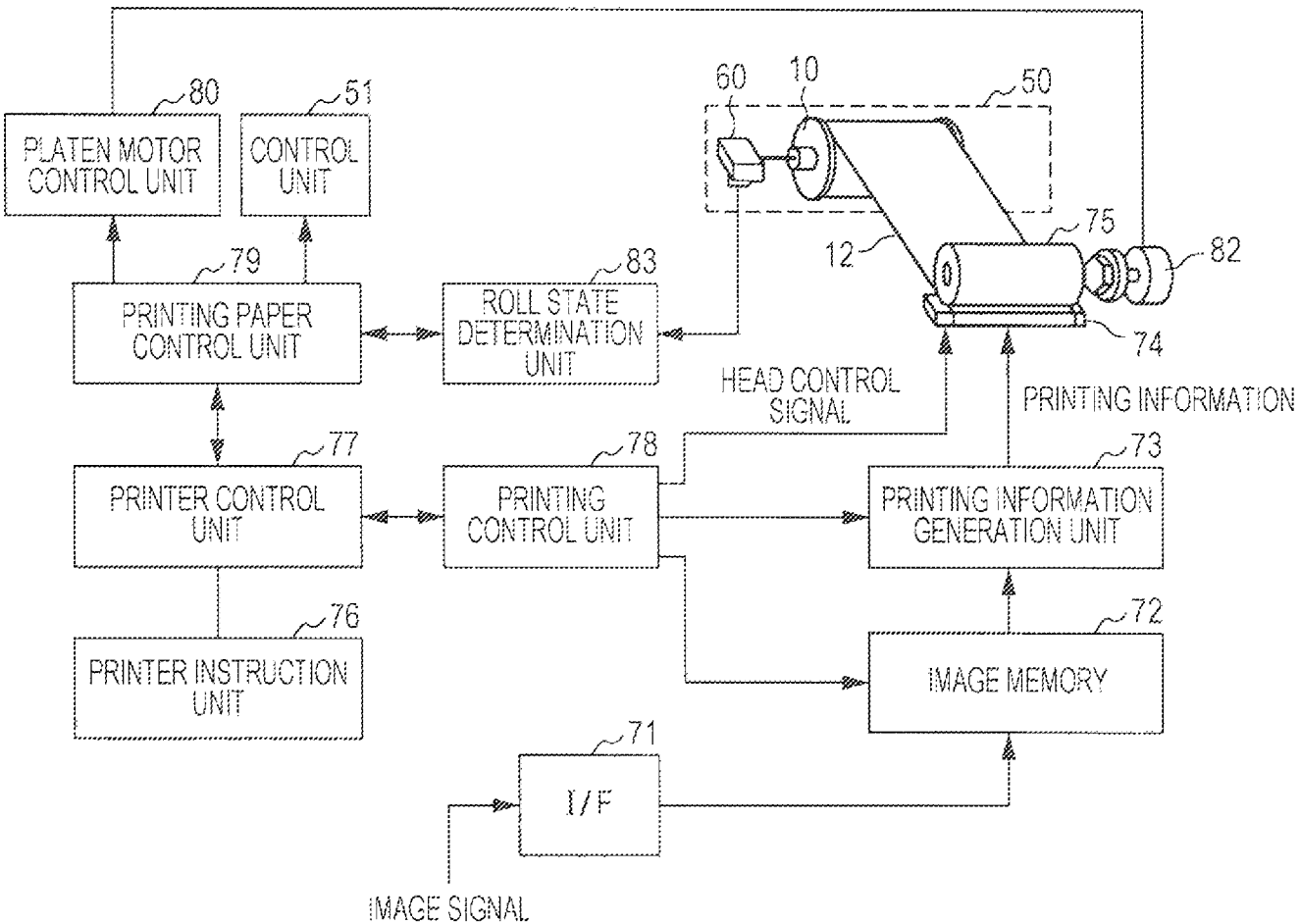
FIG. 1 is a block diagram illustrating a main configuration of a thermal printer according to an embodiment of the present disclosure.

Hereinafter, exemplary embodiments of the present disclosure will be described in detail with reference to the accompanying drawings. In addition, the constituent elements having substantially the same functional configuration are given the same reference numerals, and repeated description will be omitted in the specification and the drawings.

1. Configuration of Thermal Printer 1

First, a configuration of a thermal printer 1 (hereinafter, simply referred to as a printer 1) according to an embodiment of the present disclosure will be described with reference to FIG. 1. FIG. 1 shows a main configuration of the thermal printer 1.

As shown in FIG. 1, in the printer 1, an image signal is temporarily stored in an image memory 72 via an interface 71. The image signal is read by a printing information generation unit 73 to thereby generate printing information. The printing information is supplied to a printing head 74. The printing head 74 prints an image corresponding to the printing information on a thermal paper 12 supplied from a thermal paper roll 10 in cooperation with a platen roller 75.

An operation of the printer 1 is controlled by a printer control unit 77 in response to a key input or the like from a printer instruction unit 76. The printer control unit 77 controls the image memory 72, the printing information generation unit 73, and the printing head 74 via a printing control unit 78, and controls a platen motor control unit 80 and a display unit 81 such as an LED via a printing paper control unit 79. The platen motor control unit 80 controls rotation of the platen roller 75 via a platen motor 82.

Here, a roll tray 50 is loaded with the thermal paper roll 10, and a contact sensor 60 (generic name of contact sensors) detecting a state of the thermal paper roll 10 is provided in the roll tray 50. A roll state determination unit 83 determines the state of the thermal paper roll 10 based on a sensor signal from the contact sensor 60, and supplies a determination result to the printing paper control unit 79. The printing paper control unit 79 controls the platen motor control unit 80 or the display unit 81 according to the determination result. The determination result is also supplied to the printer control unit 77, and the printer control unit 77 controls the printing head 74 or the printing information generation unit 73 via the printing control unit 78 according to the determination result.

2. First Embodiment

Next, a first embodiment of the present disclosure will be described with reference to FIGS. 2 to 8. In the first embodiment, in order to detect the remaining amount of the thermal paper 12, a rotation state and a loading state of the thermal paper roll 10 are detected.

Figure 2:
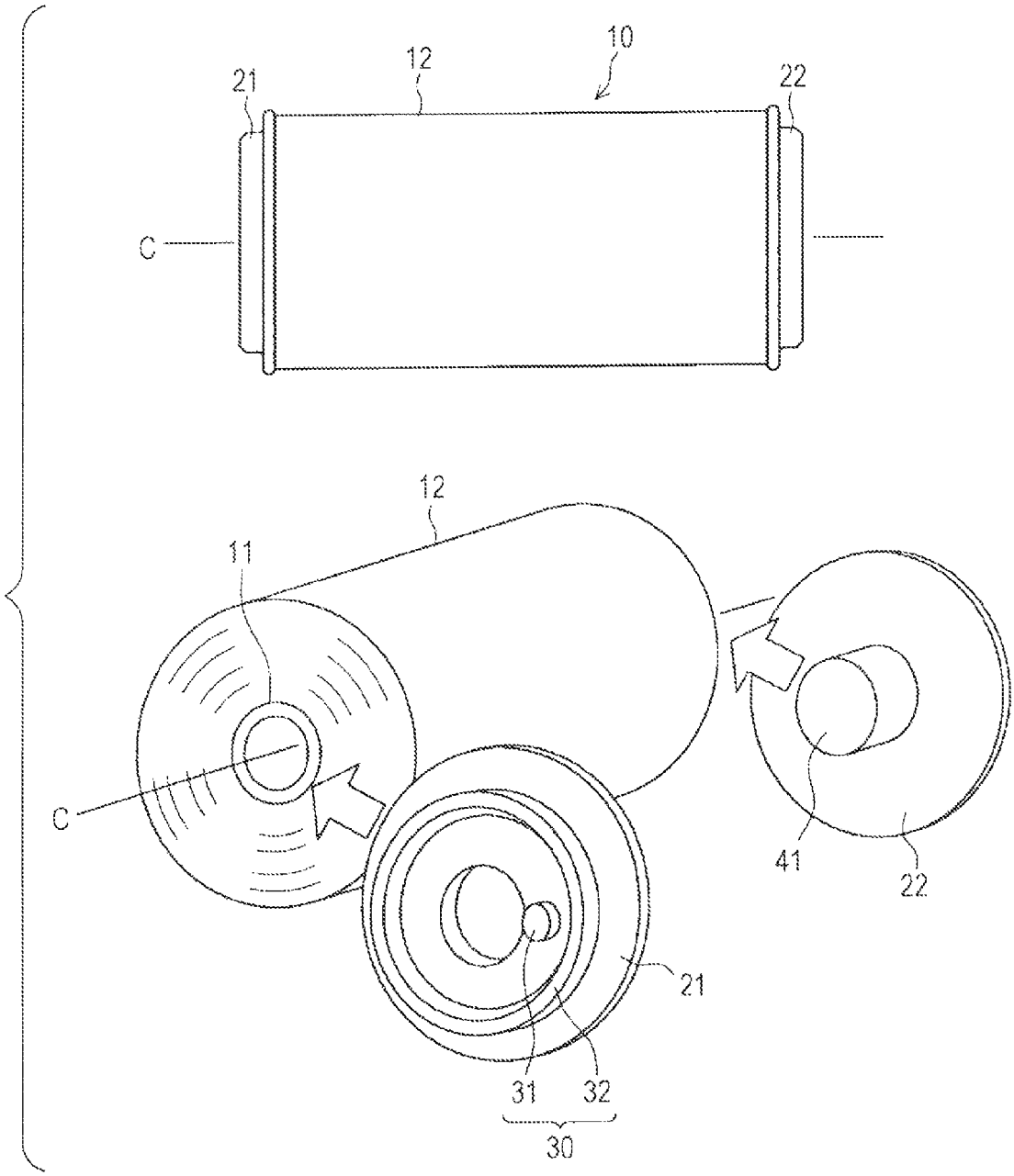
FIG. 2 is a diagram illustrating a configuration of a thermal paper roll according to a first embodiment.

FIG. 2 shows a configuration of the thermal paper roll 10 according to the first embodiment. As shown in FIG. 2, the thermal paper roll 10 includes a paper core 11, and the thermal paper 12 wound on the paper core 11. The thermal paper roll 10 includes a flange 20 (generic name of flanges) having first and second flanges 21 and 22, and a contacted surface 30 (generic name of contact surfaces) having contacted surfaces 31 and 32. The thermal paper roll 10 is typically distributed in a state where the flanges 21 and 22 are attached to the paper core 11.

The paper core 11 is a tubular or axial member for winding the thermal paper 12 in a roll shape thereon. The paper core 11, which will be described later in detail, rotates about the roll axis C which is a central axis of the thermal paper roll 10, in a state where the roll tray 50 is loaded with the thermal paper roll 10. The paper core 11 is generally formed using cardboard, or the like, however, may be formed using other materials strong enough to wind the thermal paper 12 thereon.

The first and second flanges 21 and 22 are respectively attached to both end surfaces of the paper core 11. The flanges 21 and 22 are disk-like or circular members which are attached to the paper core 11. In FIG. 2, only the first flange 21 is provided with the contacted surface 30 for detecting a state of the thermal paper roll 10. The flanges 21 and 22 are generally formed using a resin material at a low cost, however, may be formed using other materials strong enough to maintain the shape of the contacted surface 30 at a low cost. The flanges 21 and 22 are formed to such an extent that the outer diameter is similar to the maximal diameter of the thermal paper 12 wound on the paper core 11, however, may be formed to be smaller or greater than the maximal diameter of the thermal paper 12.

In each of the flanges 21 and 22, one surface thereof is provided with an attaching portion 41, and the other surface is provided with the contacted surface 30. The attaching portions 41 are members for attaching the flanges 21 and 22 to the end surfaces of the paper core 11. The attaching portions 41 may be formed using the projection-shaped member as shown in FIG. 2 or members with other shapes, or may be formed as adhering surfaces for adhering the flanges 21 and 22 to the end surfaces of the paper core 11.

The contacted surface 30 is formed on a plane intersecting the roll axis C of the paper core 11 at the opposite side to the paper core 11 in a state where the flanges 21 and 22 are attached to the paper core 11. The contacted surface 30 is formed as a convex surface or a concave surface at the opposite side to the paper core 11. In FIG. 2, the contacted surface 30 is formed on the first flange 21 as the boss-shaped convex surface which is a rotation state detection surface 31 and the circular convex surface which is a loading state detection surface 32.

The rotation state detection surface 31 is formed as the boss-shaped convex surface at a predetermined angular position with respect to the roll axis C of the paper core 11 in a state where the first flange 21 is attached to the paper core 11. The loading state detection surface 32 is formed as the circular convex surface having the roll axis C of the paper core 11 as a center, in a state where the first flange 21 is attached to the paper core 11.

Figure 3:
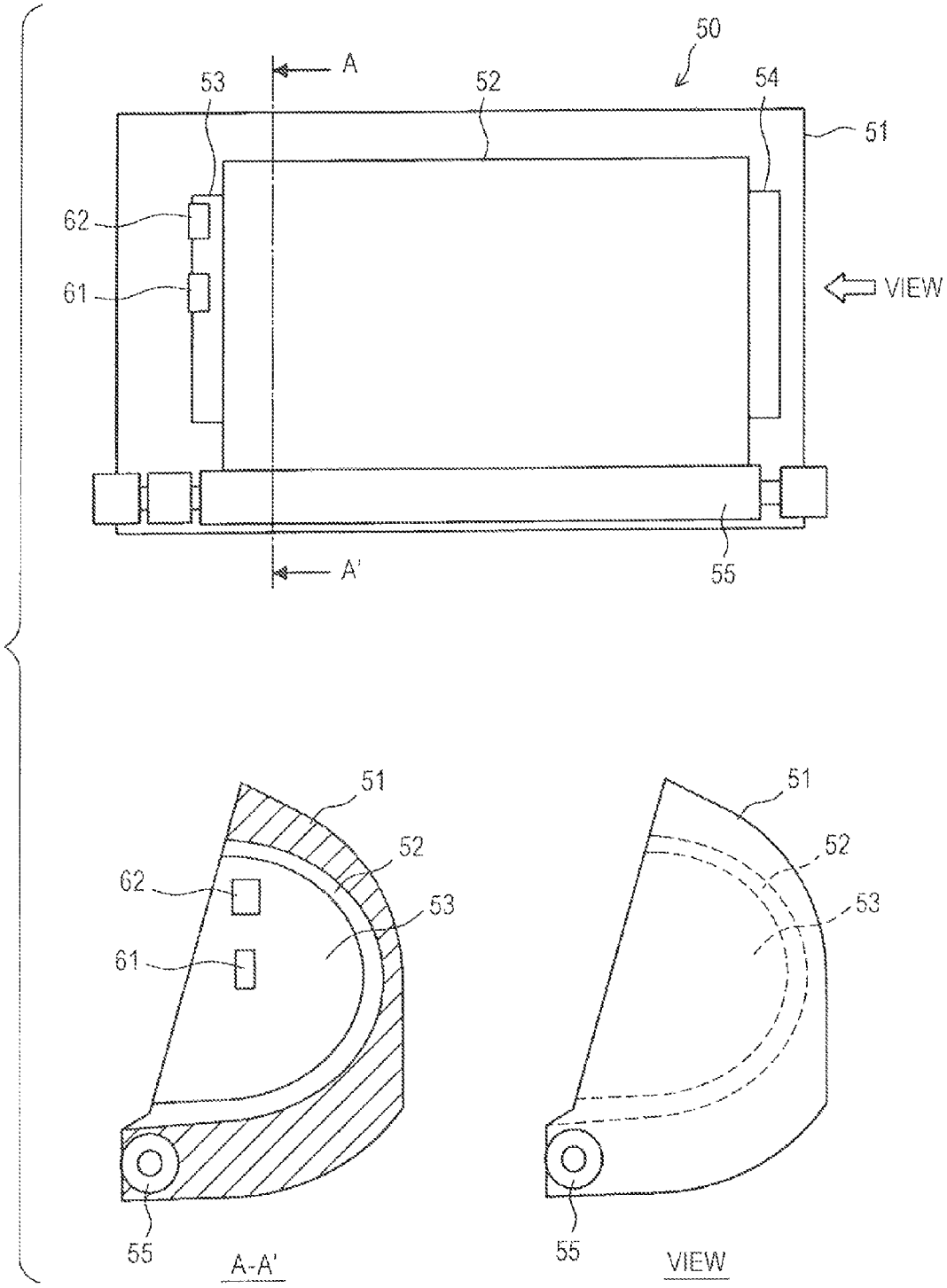
FIG. 3 shows a plan view, a side view, and a cross-sectional view of a roll tray which is loaded with the thermal paper roll.
Figure 4:
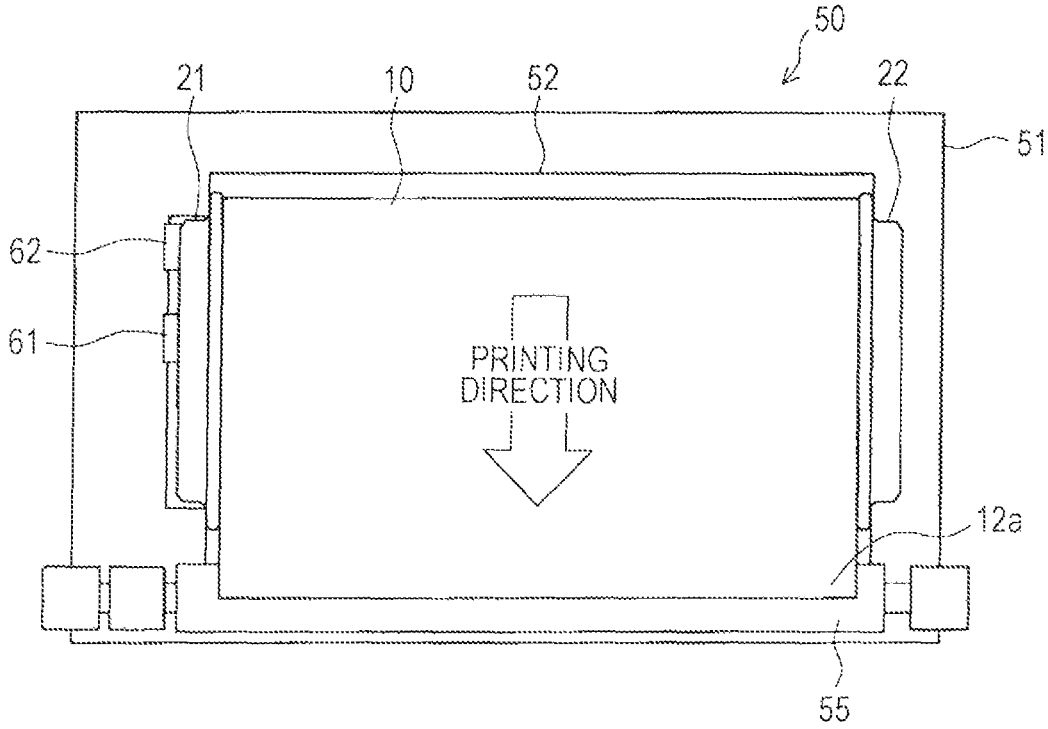
FIG. 4 is a plan view illustrating a state where the roll tray is loaded with the thermal paper roll.

FIG. 3 shows the roll tray 50 which is loaded with the thermal paper roll 10. FIG. 4 shows a state where the roll tray 50 is loaded with the thermal paper roll 10. As shown in FIG. 3, the roll tray 50 is constituted by a casing 51 having an opening surface, and the casing 51 includes accommodating portions which accommodate the thermal paper roll 10, and the contact sensor 60 which detects a state of the thermal paper roll 10 via the contacted surface 30 formed on the flange 21.

The accommodating portions include a center accommodating portion 52 accommodating the central portion of the thermal paper roll 10, and first and second lateral surface accommodating portions 53 and 54 accommodating the lateral surface portion of the thermal paper roll 10. The center accommodating portion 52 is formed as a concave portion having an arc cross section with the diameter larger than that of the thermal paper roll 10. The lateral surface accommodating portions 53 and 54 are formed as a concave portion having an arc cross section with diameters which are slightly larger than those of the convex portions of the flanges 21 and 22 (refer to the side view and the cross-sectional view).

The first lateral surface accommodating portion 53 accommodates the end portion (including the contacted surface 30) of the first flange 21, and the second lateral surface accommodating portion 54 accommodates the end portion of the second flange 22. Contact sensors 61 and 62 for detecting a state of the thermal paper roll 10 via the contacted surface 30 are provided at the lateral surface of the first lateral surface accommodating portion 53. The contact sensor 60 is installed at a position capable of facing the contacted surface 30 which is formed on the plane intersecting the roll axis C of the paper core 11 at the opposite side to the paper core 11 of the flange 21.

The contact sensor 60 includes the rotation state detection sensor 61 for detecting a rotation state of the thermal paper roll 10 and the loading state detection sensor 62 for detecting a loading state of the thermal paper roll 10. The rotation state detection sensor 61 is disposed to face the rotation state detection surface 31 of the thermal paper roll 10 with which the roll tray 50 is loaded, when the thermal paper roll 10 rotates one time. The loading state detection sensor 62 is disposed to face at all times the loading state detection surface 32 of the thermal paper roll 10 with which the roll tray 50 is loaded.

A paper discharge mechanism including a paper discharge roller 55 for drawing the thermal paper 12 from the thermal paper roll 10 installed in the roll tray 50 is provided in front of the roll tray 50. As shown in FIG. 4, the thermal paper roll 10 is installed in the roll tray 50 in a state where a drawer end 12*a* of the thermal paper 12 is wound on the paper discharge roller 55, and supplies the thermal paper 12 in the printing direction while rotating about the roll axis C according to the rotation of the paper discharge roller 55. Here, the thermal paper roll 10 is installed in the roll tray 50 in a state where the thermal paper 12 does not come into contact with the inner surface of the center accommodating portion 52, and smoothly rotates about the roll axis C in a state of being guided by the lateral surface accommodating portions 53 and 54.

Figure 5:
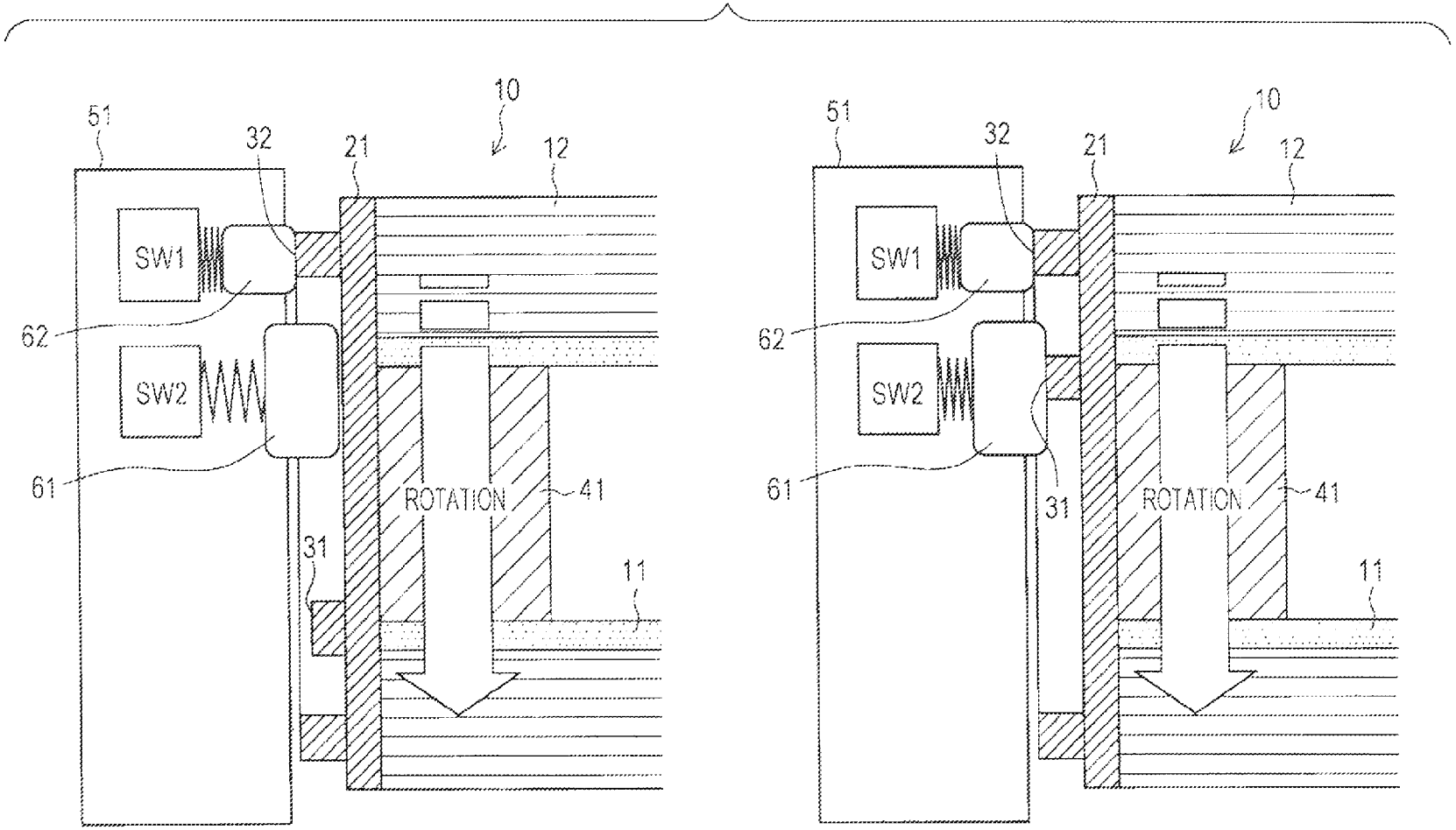
FIG. 5 is a diagram illustrating operations of a rotation state detection sensor and a loading state detection sensor.

FIG. 5 shows operations of the rotation state detection sensor 61 and the loading state detection sensor 62. As shown in FIG. 5, the loading state detection sensor 62 is pressed by the loading state detection surface 32 at all times in a state where the roll tray 50 is loaded with the thermal paper roll 10 (left and right views of FIG. 5). On the other hand, the rotation state detection sensor 61 is not pressed by the rotation state detection surface 31 when it does not face the rotation state detection surface 31 due to the rotation of the thermal paper roll 10 (left view of FIG. 5), and is pressed by the rotation state detection surface 31 when it faces the rotation state detection surface 31 (right view of FIG. 5). The rotation state detection sensor 61 and the loading state detection sensor 62 output sensor signals according to a state of the thermal paper roll 10 to the roll state determination unit 83.

Figures 6, 7:
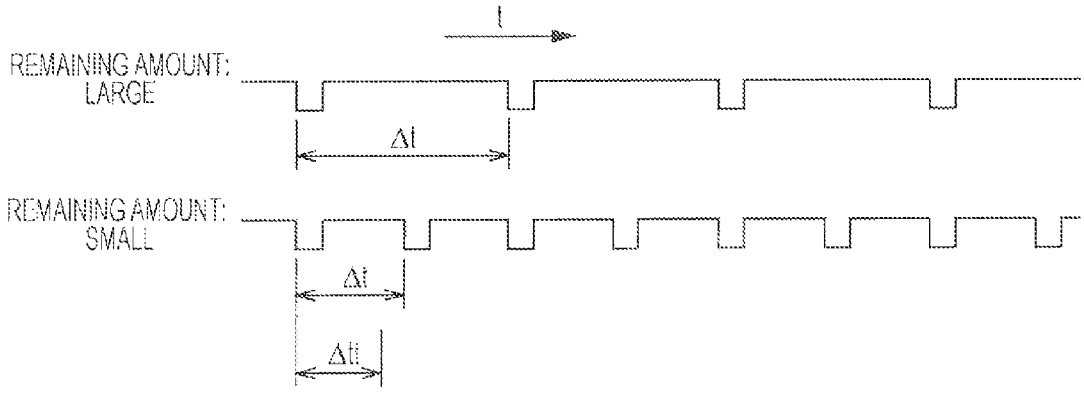
FIG. 6 is a diagram illustrating sensor signals from the rotation state detection sensor and the loading state detection sensor.
FIG. 7 is a diagram illustrating a relationship between the remaining amount of the thermal paper and a sensor signal from the rotation state detection sensor.

FIG. 6 shows sensor signals from the rotation state detection sensor 61 and the loading state detection sensor 62. As shown in FIG. 6, the loading state detection sensor 62 outputs a low signal indicating a loading state in a state of being pressed by the loading state detection surface 32, and outputs a high signal indicating an unloading state in a state of not being pressed.

In a similar manner, the rotation state detection sensor 61 outputs a low signal indicating that the rotation state detection surface 31 faces the rotation state detection sensor 61 in a state of being pressed by the rotation state detection surface 31, and outputs a high signal indicating that the rotation state detection surface 31 does not face the rotation state detection sensor 61 in a state of not being pressed.

In addition, the rotation state detection sensor 61 outputs a high signal indicating that the rotation state detection surface 31 does not face the rotation state detection sensor 61 in a state where the thermal paper roll 10 is not installed. As a combination of a state of the thermal paper roll 10 and the sensor signals, other combinations may be used.

Here, a case where the thermal paper 12 is supplied from the thermal paper roll 10 at a constant speed and constant length is assumed. In this case, the larger the roll diameter of the thermal paper roll 10, the lower the speed of the thermal paper roll 10 rotating about the roll axis C. In other words, the greater the amount of remaining thermal paper 12, the lower the rotation speed of the thermal paper roll 10. Therefore, it is possible to detect the remaining amount of the thermal paper 12 by detecting the rotation speed of the thermal paper roll 10.

FIG. 7 shows a relationship between the remaining amount of the thermal paper 12 and a sensor signal from the rotation state detection sensor 61. In addition, in FIG. 7, a case where the thermal paper 12 is supplied from the thermal paper roll 10 at a constant speed and constant length is assumed. As shown in FIG. 7, when the remaining amount of the thermal paper 12 is large, the rotation speed of the thermal paper roll 10 is lowered, and thus an output interval $\Delta t$ between a falling edge of the low signal and a falling edge of the next low signal from the rotation state detection sensor 61 is lengthened. In contrast, if the remaining amount of the thermal paper 12 becomes small, the rotation speed of the thermal paper roll 10 is heightened, and thus the output interval $\Delta t$ between a falling edge of the low signal and a falling edge of the next low signal from the rotation state detection sensor 61 is relatively shortened.

For this reason, the output interval Δt between a falling edge of the low signal and a falling edge of the next low signal from the rotation state detection sensor 61 is measured, and if the output interval Δt becomes equal to or less than the threshold value Δtt, it is possible to notify a user that the thermal paper roll 10 is depleted or exchange thereof is necessary. In this case, for example, it is preferable that a rotation speed of the thermal paper roll 10 of when the thermal paper 12 is 90% used is obtained, and a corresponding output interval Δt of the low signal is calculated as the threshold value Δtt.

Figure 8:
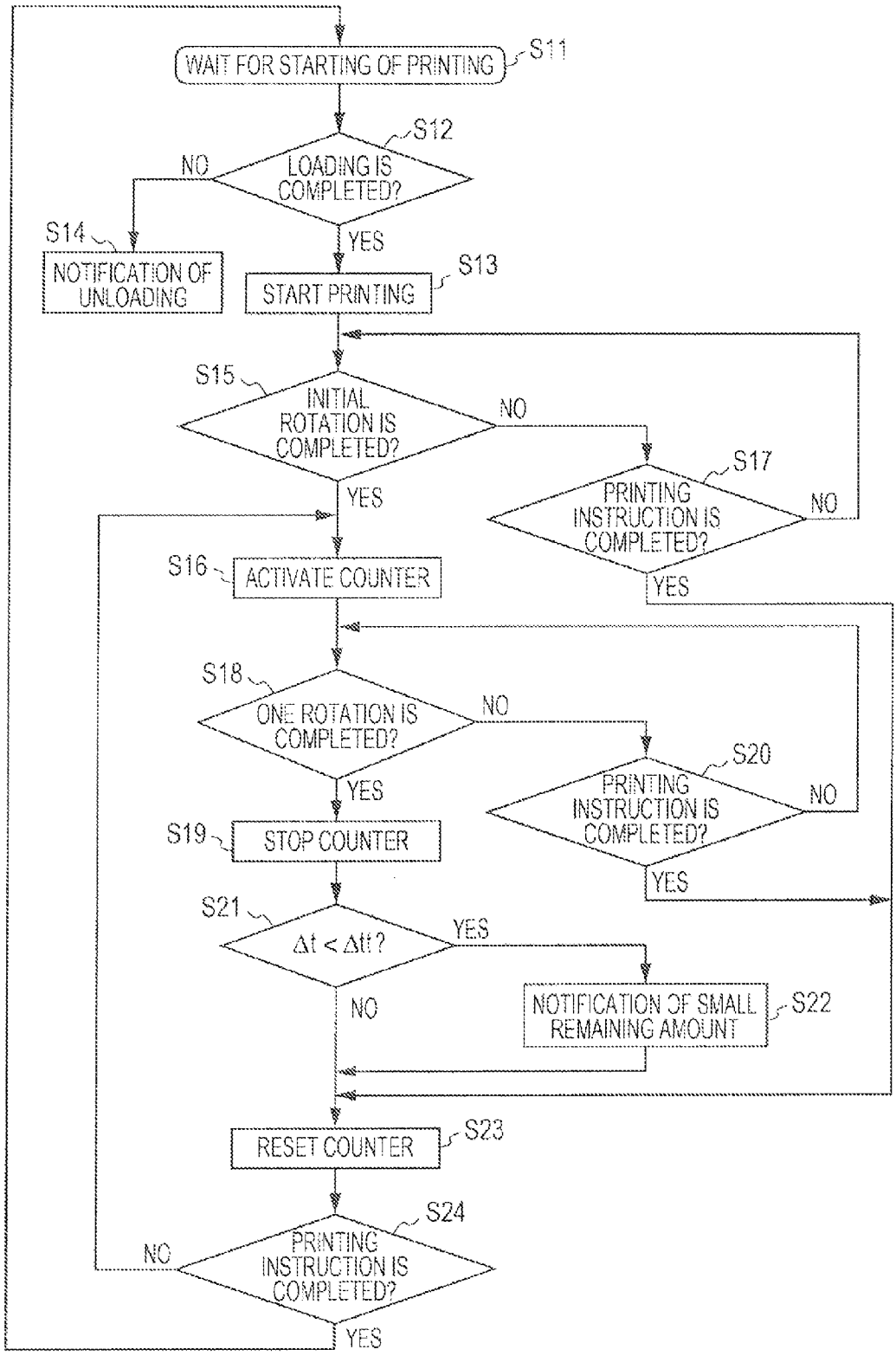
FIG. 8 is a flowchart illustrating operation procedures of the thermal printer.

FIG. 8 shows operation procedures of the thermal printer 1. As shown in FIG. 8, when a user instructs start of printing (step S11), the roll state determination unit 83 determines a loading state of the thermal paper roll 10 based on a sensor signal from the loading state detection sensor 62 (step S12). Here, if the low signal (loading state) is detected, printing starts via the printer control unit 77 (step S13), and if the high signal (unloading state) is detected, the user is notified of "unloading of thermal paper" via the display unit 81 (step S14).

When the printing starts, the roll state determination unit 83 determines whether or not the rotation state detection surface 31 operates the rotation state detection sensor 61 for the first time after the start of printing (whether or not an initial rotation is completed) based on a sensor signal from the rotation state detection sensor 61 (step S15). Here, if the rotation state detection surface 31 operates the rotation state detection sensor 61 and then the low signal is detected, a counter is activated (step S16). On the other hand, if the high signal is detected, it is checked whether or not a printing instruction is completed (step S17), and if the printing instruction is completed, the counter is reset (step S23). If the printing instruction is not completed, it is determined again whether or not the rotation state detection surface 31 operates the rotation state detection sensor 61 such that the low signal is detected (step S15).

If the rotation state detection surface 31 operates the rotation state detection sensor 61, the low signal is detected, and the counter is activated, the roll state determination unit 83 determines whether or not the thermal paper roll 10 completes one rotation based on a sensor signal from the rotation state detection sensor 61 (step S18). Here, if the low signal (completion of one rotation) is detected, the counter stops (step S19). On the other hand, if the high signal is detected, it is determined whether or not the printing instruction is still performed (step S20). If the printing instruction is completed, the printing operation finishes and the counter is reset without waiting for the rotation state detection surface 31 to operate the rotation state detection sensor 61 such that the low signal is detected (step S23), and if the printing is not completed, the determination is performed again (step S18).

After, the printing operation starts, if the counter is activated at a time point when the rotation state detection surface 31 operates the rotation state detection sensor 61 and the low signal is detected, and the counter stops when the rotation state detection surface 31 operates the rotation state detection sensor 61 again and the low signal is detected, the roll state determination unit 83 determines whether or not the output interval Δt of the low signal is smaller than the threshold value Δtt based on the counting value of the counter (step S21). In addition, if the condition is satisfied, the user is notified of a "small remaining amount of thermal paper" via the display unit 81 or the like (step S22). If the determination of the output interval Δt is completed, the counter is reset (step S23), and the above-described operations are repeated until the printing instruction is completed (step S24). Further, if the printing is completed, the start of the next printing instruction is awaited (step S11).

According to this embodiment, it is possible to detect the remaining amount of the thermal paper 12 with a simple configuration, by detecting a rotation state of the thermal paper roll 10 through the contacted surface 30 provided in the thermal paper roll 10. In addition, it is possible to notify a user that the thermal paper 12 is depleted, exchange thereof is necessary or the like, according to the detection result of the remaining amount.

3. Second Embodiment

Next, a second embodiment of the present disclosure will be described with reference to FIGS. 9 to 13. In the second embodiment, a roll type of the thermal paper roll 10 is detected in order to detect the kind of thermal paper 12.

Figure 9:
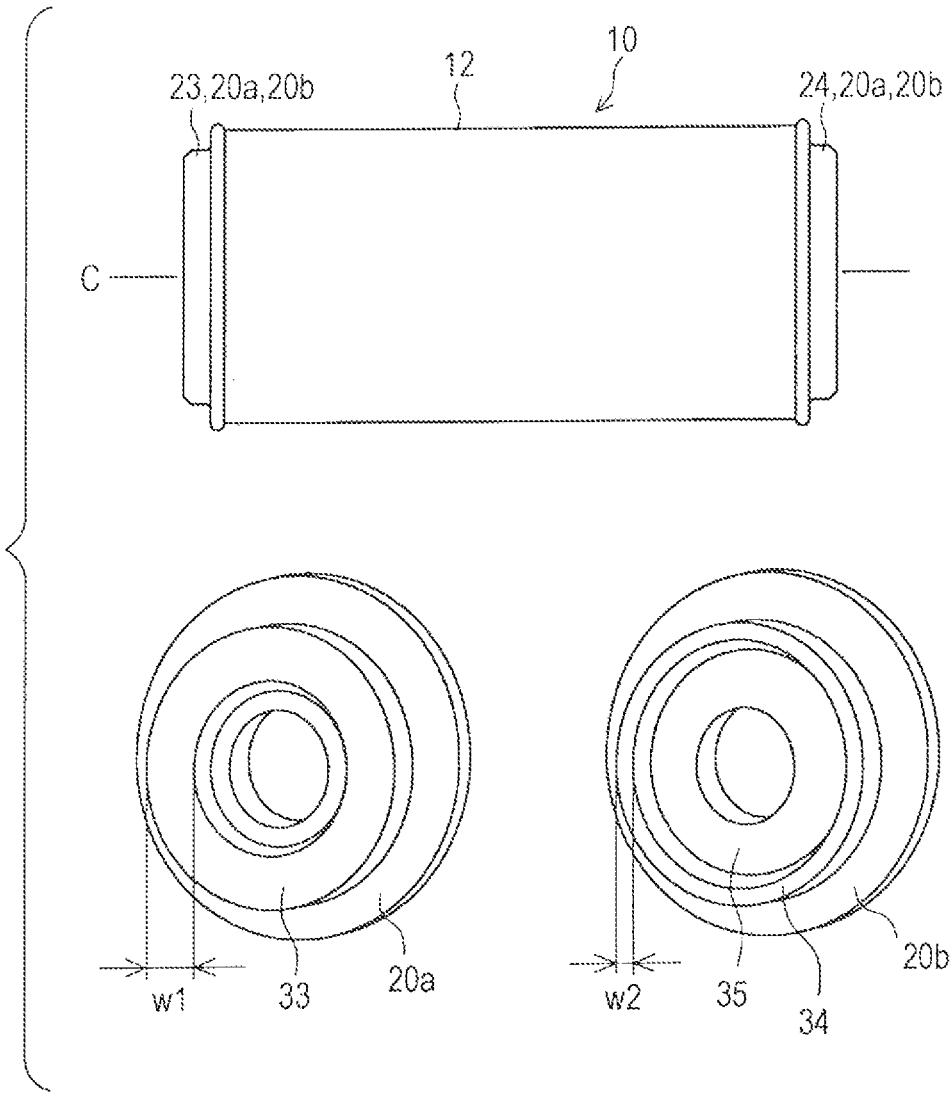
FIG. 9 is a diagram illustrating a configuration of a thermal paper roll according to a second embodiment.

FIG. 9 shows a configuration of the thermal paper roll 10 according to the second embodiment. As shown in FIG. 9, the thermal paper roll 10 has the paper core 11, the thermal paper 12, first and second flanges 23 and 24, and the contacted surface 30 including contacted surfaces 33, 34 and 35, as in the first embodiment.

In FIG. 9, as the first and second flanges 23 and 24, A type or B type flanges 20*a* and 20*b* are used. In other words, the first and second flanges 23 and 24 have several flange combinations of A type and A type, A type and B type, B type and A type, and B type and B type. On one surface of each of the A type and B type flanges 20*a* and 20*b*, the contacted surface 30 is formed on a plane intersecting the roll axis C of the paper core 11 at the opposite side to the paper core 11 in a state where the flanges 20*a* and 20*b* are attached to the paper core 11.

A circular convex surface 33 with the width W1 is formed on the A type flange 20*a*, and a convex surface 34 with the width W2 (W2<W1) is formed on the B type flange 20*b*. In the A type flange 20*a*, the convex surface 33 functions as a loading state detection surface and a roll type detection surface. On the other hand, in the B flange 20*b*, the convex surface 34 functions as a loading state detection surface, and a planarized surface 35 adjacent to the convex surface 34 functions as a roll type detection surface.

In addition, the roll type detection surface may be formed as a combination of a convex surface and a concave surface, or a concave surface and a planarized surface, instead of the convex surface 33 and the planarized surface 35. In addition, two or more roll type detection surfaces may be formed on each of the flanges 20*a* and 20*b*.

Figure 10:
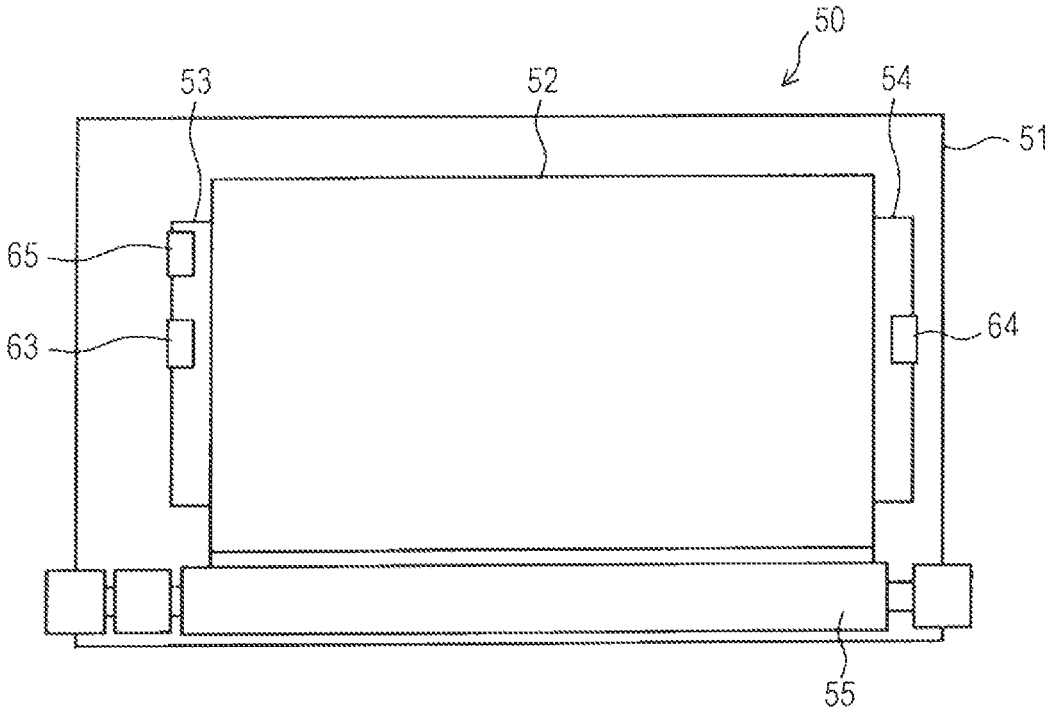
FIG. 10 is a plan view illustrating a roll tray which is loaded with the thermal paper roll.

FIG. 10 shows the roll tray 50 with which the thermal paper roll 10 is loaded. As shown in FIG. 10, as in the first embodiment, the roll tray 50 is provided with accommodating portions including the center accommodating portion 52 and the first and second lateral surface accommodating portions 53 and 54, and contact sensors 63, 64 and 65 for detecting a state of the thermal paper roll 10 via the contacted surface 30.

The first roll type detection sensor 63 for detecting a roll type of the thermal paper roll 10 and the loading state detection sensor 65 for detecting a loading state of the thermal paper roll 10 are provided at the lateral surface of the first lateral surface accommodating portion 53. On the other hand, the second roll type detection sensor 64 for detecting a roll type of the thermal paper roll 10 is provided at the lateral surface of the second lateral surface accommodating portion 54.

The roll type detection sensors 63 and 64 are disposed to face at all times the roll type detection surfaces (the planarized surface 33, the concave surface 35, and the like) of the thermal paper roll 10 installed in the roll tray 50. The loading state detection sensor 65 is disposed to face at all times the loading state detection surfaces (the convex surfaces 33 and 34, and the like) of the thermal paper roll 10 installed in the roll tray 50.

Figure 11:
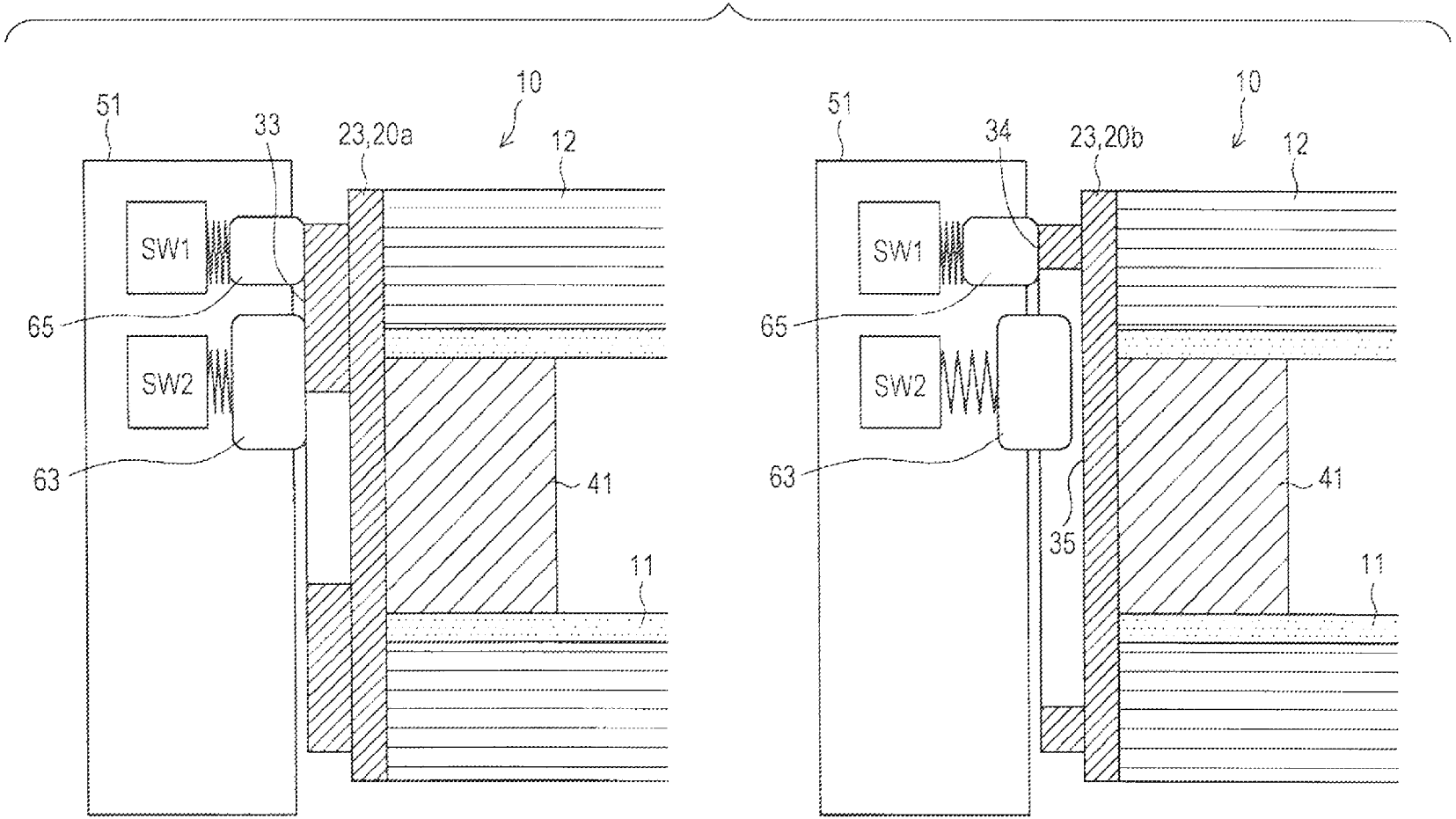
FIG. 11 is a diagram illustrating operations of a roll type detection sensor and a loading state detection sensor.

FIG. 11 shows operations of the roll type detection sensor 63 and the loading state detection sensor 65. As shown in FIG. 11, the loading state detection sensor 65 is pressed by the loading state detection surfaces (the convex surfaces 33 and 34 and the like) at all times in a state where the roll tray 50 is loaded with the thermal paper roll 10 (left and right views of FIG. 11).

On the other hand, the roll type detection sensor 63 is pressed by the roll type detection surfaces according to the shapes of the roll type detection surfaces (the convex surface 33, the planarized surface 35, and the like) in a state where the roll tray 50 is loaded with the thermal paper roll 10. In other words, the roll type detection sensor 63 is pressed by the roll type detection surface formed as the convex surface 33 such as the A type flange 20*a* (the left view of FIG. 11), and is not pressed by the roll type detection surface formed as the planarized surface 35 such as the B type flange 20*b* (the right view of FIG. 11).

Here, a case where the printer 1 is controlled depending on a roll type of the thermal paper roll 10 (the kind of the thermal paper 12) is assumed. In this case, at least four roll types can be detected depending on combinations of the roll type detection surfaces formed on the first and second flanges 23 and 24. In addition, hereinafter, a case where the first roll type detection surface is formed on the first flange 23 and the second roll type detection surface is formed on the second flange 24 is assumed.

FIG. 12 shows sensor signals from the roll type detection sensors 63 and 64 and the loading state detection sensor 65. As shown in FIG. 12, the loading state detection sensor 65 outputs a low signal indicating a loading state in a state of being pressed by the loading state detection surfaces (convex surfaces 33 and 34, and the like), and outputs a high signal indicating an unloading state in a state of not being pressed. In a similar manner, the roll type detection sensors 63 and 64 output a low signal indicating that the roll type detection surface is the convex surface 33 in a state of being pressed by the roll type detection surface, and outputs a high signal indicating that the roll type detection surface is the planarized surface 35 in a state of not being pressed.

Here, a case of detecting first to fourth roll types depending on the combinations of the first and second roll type detection surfaces is assumed. The first roll type includes the first and second flanges 23 and 24 both of which are the A type flange 20*a*. The second roll type includes the first and second flanges 23 and 24 which are respectively A type and B type flanges 20*a* and 20*b*. The third roll type includes the first and second flanges 23 and 24 which are respectively B type and A type flanges 20*b* and 20*a*. The fourth roll type includes the first and second flanges 23 and 24 both of which are the B type flange 20*b*.

In this case, for example, if the thermal paper roll 10 of the first roll type is installed, the first and second roll type detection sensors 63 and 64 output the low signal. In addition, if the thermal paper roll 10 of the second roll type is installed, the first roll type detection sensor 63 outputs the low signal, and the second roll type detection sensor 64 outputs the high signal.

The roll type detection sensors 63 and 64 output the high signal indicating that the roll type detection surface is a concave surface in a state where the thermal paper roll 10 is not installed. In addition, as the combinations of a state of the thermal paper roll 10 and the sensor signals, other combinations may be used.

Figure 13:
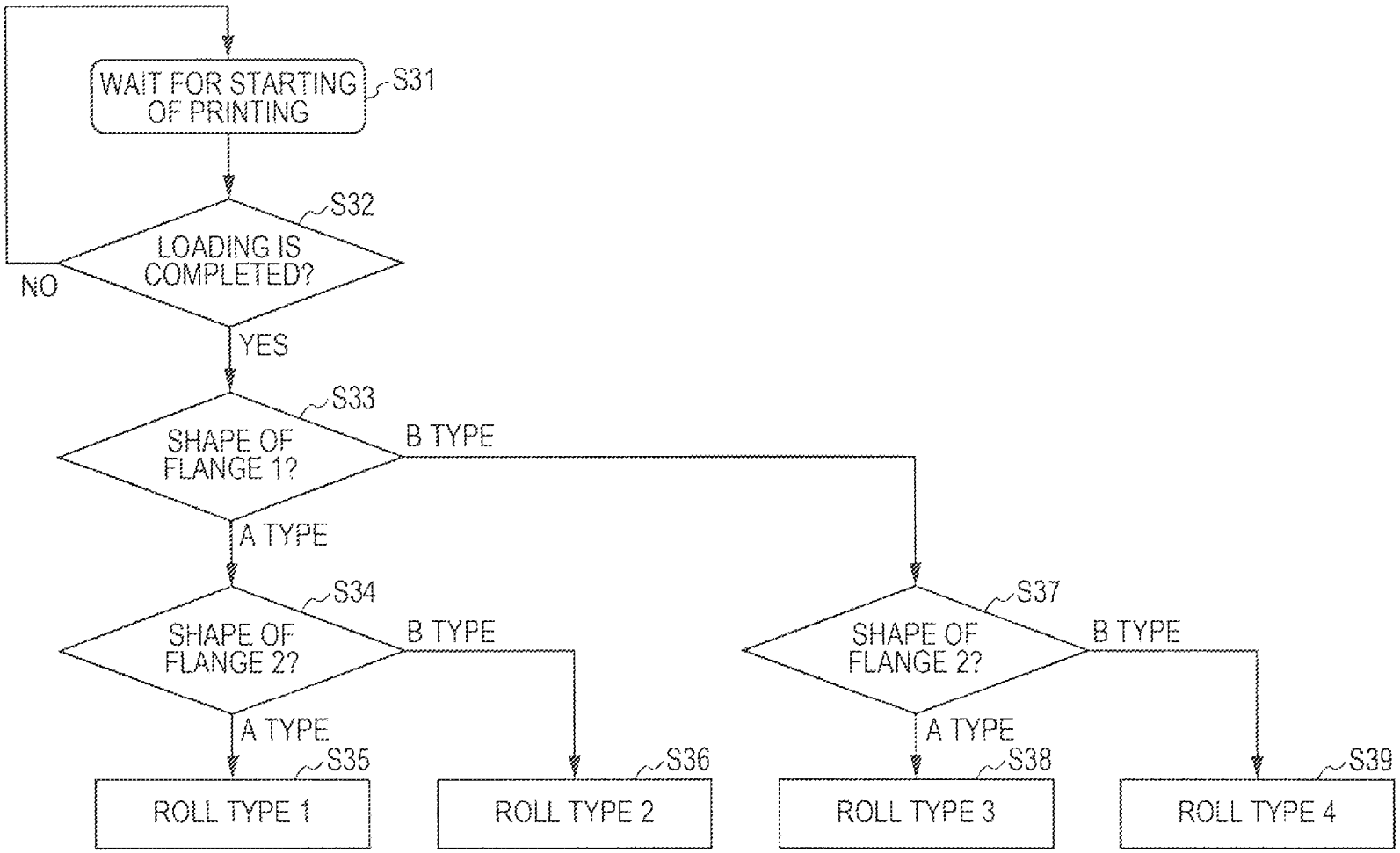
FIG. 13 is a flowchart illustrating operation procedures of the thermal printer.

FIG. 13 shows operation procedures of the thermal printer 1. As shown in FIG. 13, when a user instructs start of printing (step S31), the roll state determination unit 83 determines the loading state of the thermal paper roll 10 based on a sensor signal from the loading state detection sensor 65 (step S32). Here, if the low signal (loading state) is detected, determination of a roll type starts successively (step S33), and if the high signal (unloading state) is detected, the user is notified of "unloading of thermal paper" via the display unit 81.

If the determination of a roll type starts, the roll state determination unit 83 determines between the roll types 1 and 2, and the roll types 3 and 4 based on a sensor signal from the first roll type detection sensor 63 (step S33). If the low signal is detected, the roll state determination unit 83 determines between the roll types 1 and 2 based on a sensor signal from the second roll type detection sensor 64 (step S34). If the low signal is detected again, the roll type 1 is specified (step S35), and if the high signal is detected, the roll type 2 is specified (step S36).

On the other hand, if the high signal is detected, the roll state determination unit 83 determines between the roll types 3 and 4 based on a sensor signal from the second roll type detection sensor 64 (step S37). If the low signal is detected again, the roll type 3 is specified (step S38), and if the high signal is detected, the roll type 4 is specified (step S39).

According to this embodiment, it is possible to detect the kind of thermal paper 12 with a simple configuration by detecting the roll type of thermal paper roll 10 via the contacted surface 30 provided in the thermal paper roll 10. In addition, it is possible to perform controls (controls for adjusting printing speed, concentration, and density) according to the kind of thermal paper 12 without operations designated by a user.

4. Third Embodiment

Next, a third embodiment of the present disclosure will be described with reference to FIGS. 14 to 16. In the third embodiment, in order to prevent the thermal paper roll 10 from being installed in the wrong direction, the loading direction of the thermal paper roll 10 is identified.

Figure 14:
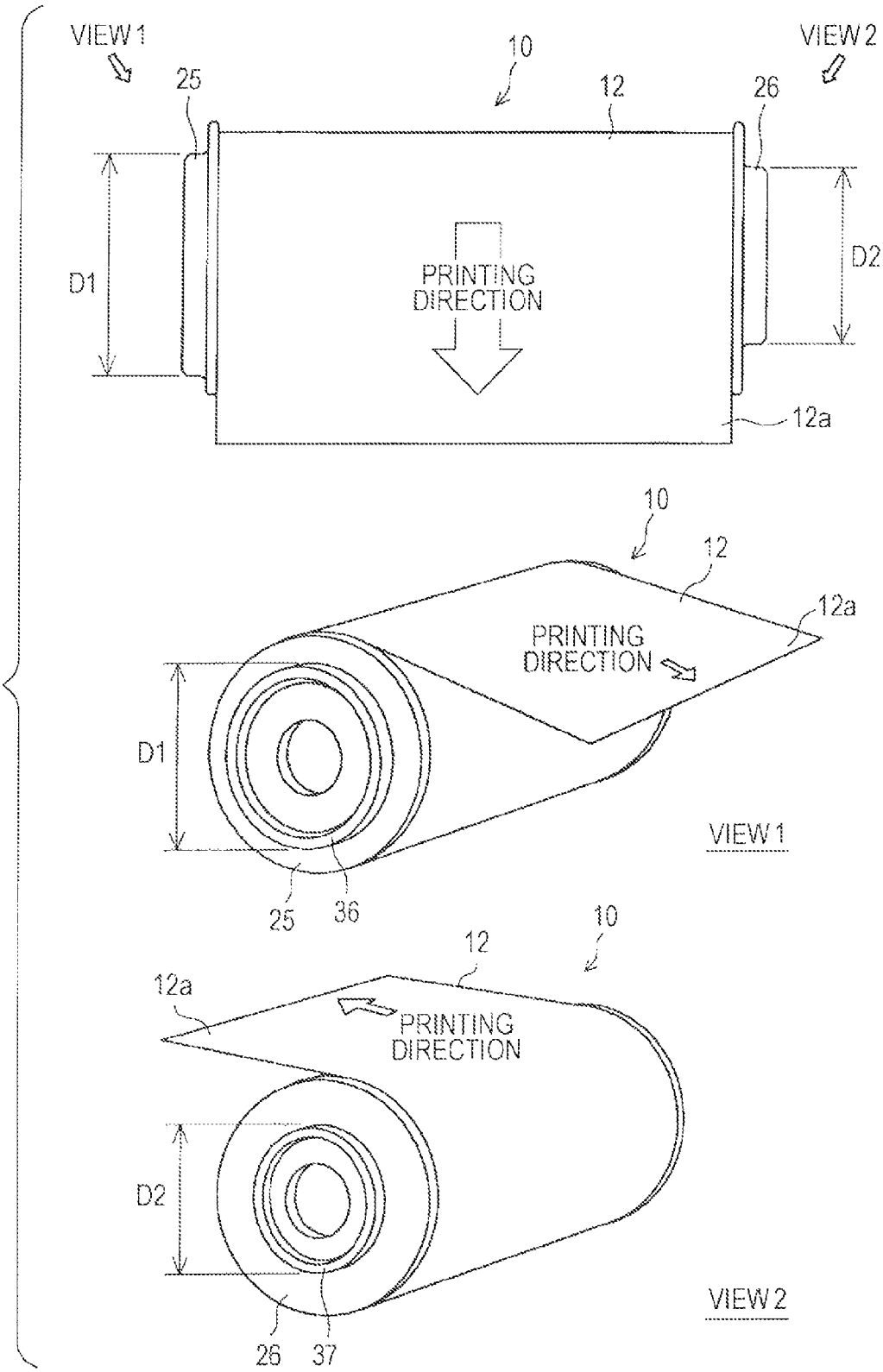
FIG. 14 is a diagram illustrating a configuration of a thermal paper roll according to a third embodiment.

FIG. 14 shows a configuration of the thermal paper roll 10 according to the third embodiment. In FIG. 14, states seen from sides of the left and right end surfaces of the thermal paper roll 10 are shown. As shown in FIG. 14, the thermal paper roll 10, as in the first embodiment, includes the paper core 11, the thermal paper 12, first and second flanges 25 and 26, and the contacted surface 30 having contacted surfaces 36 and 37. The thermal paper 12 is drawn from the thermal paper roll 10 via the drawer end 12*a*.

On one surface of each of the first and second flanges 25 and 26, the contacted surface 30 is formed on a plane intersecting the roll axis C of the paper core 11 at the opposite side to the paper core 11 in a state where the flanges 25 and 26 are attached to the paper core 11. In FIG. 14, a circular convex surface which is a first loading direction identification surface 36 is formed on the first flange 25, and a circular convex surface which is a second loading direction identification surface 37 is formed on the second flange 26.

The loading direction identification surfaces 36 and 37 are formed as the circular convex surfaces having the roll axis C of the paper core 11 as a center in a state where the flanges 25 and 26 are attached to the paper core 11. The loading direction identification surfaces are formed as convex surfaces of which, for example, the outer diameter D1 of the first loading direction identification surface 36 is larger than the outer diameter D2 of the second loading direction identification surface 37.

Figure 15:
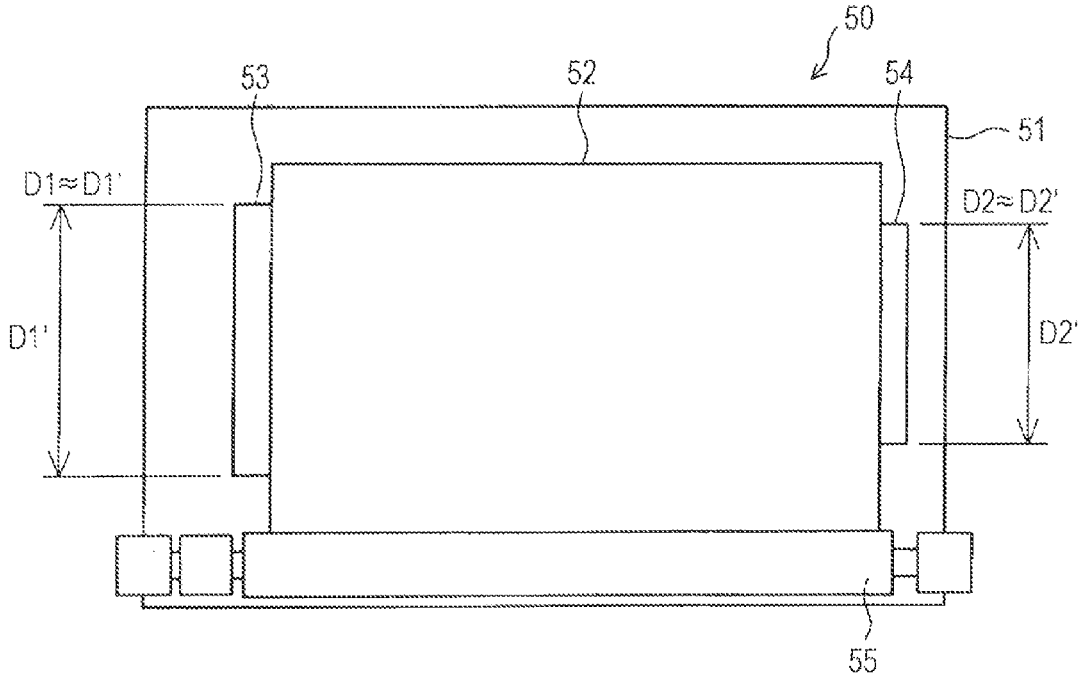
FIG. 15 is a plan view illustrating a roll tray which is loaded with the thermal paper roll.

FIG. 15 shows the roll tray 50 which is loaded with the thermal paper roll 10. As shown in FIG. 15, as in the first embodiment, the roll tray 50 is provided with the accommodating portions which include the center accommodating portion 52, and the first and second lateral surface accommodating portions 53 and 54.

The first lateral surface accommodating portion 53 is formed to have the diameter D1' which is slightly larger than that of the first loading direction identification surface 36. On the other hand, the second lateral surface accommodating portion 54 is formed to have the diameter D2' which is smaller than that of the first loading direction identification surface 36 and is slightly larger than that of the second loading direction identification surface 37.

However, it is necessary for the thermal paper roll 10 to be disposed in a predetermined direction with respect to the roll tray 50, and to be installed in the roll tray 50 in a state where the drawer end 12*a* of the thermal paper 12 is wound on the paper discharge roller 55. This is because if the disposition direction of the roll tray 50 is erroneous, the thermal paper 12 may not be appropriately supplied in the printing direction.

Figure 16:
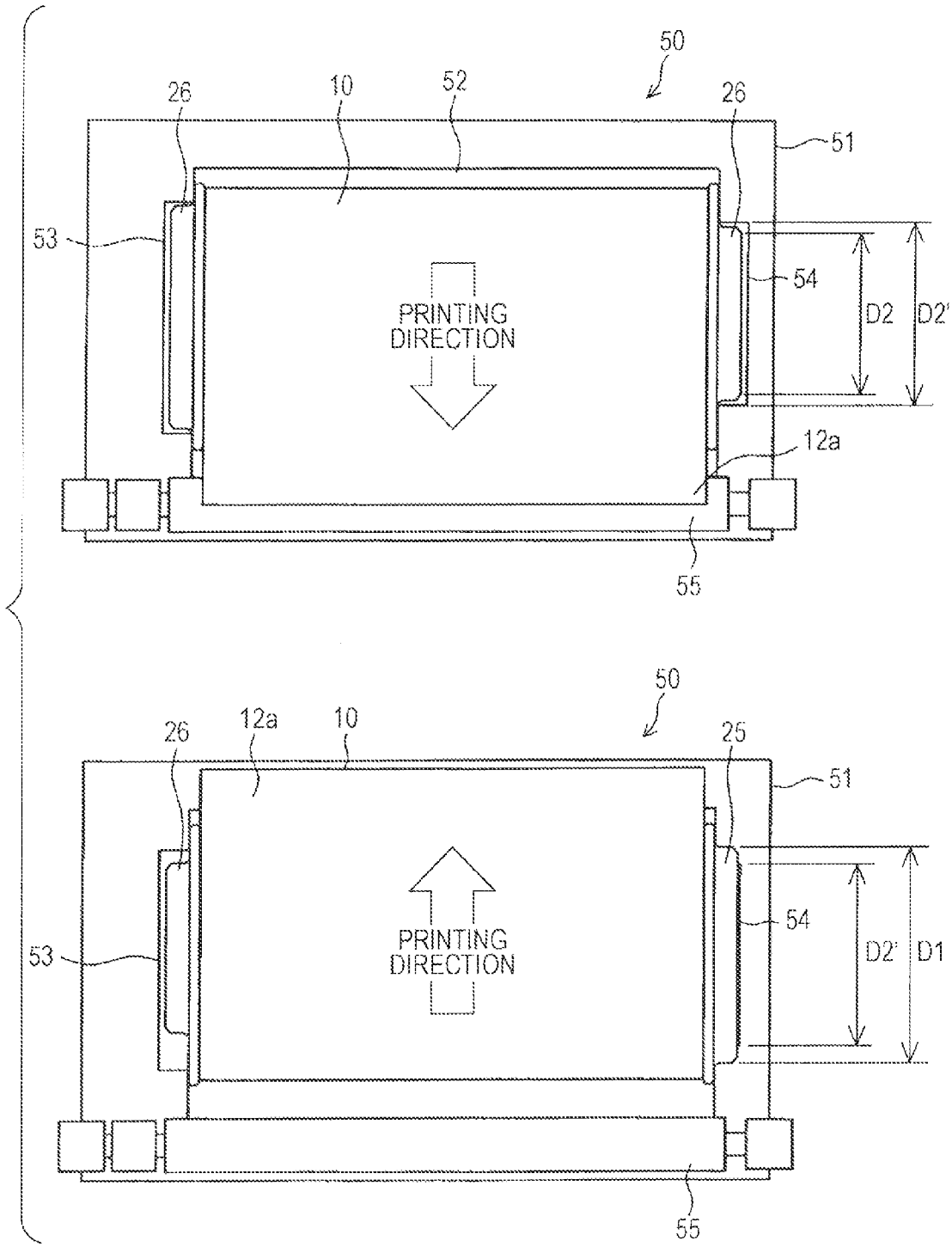
FIG. 16 is a diagram illustrating the loading state of the thermal paper roll.

FIG. 16 shows the loading state of the thermal paper roll 10. As shown in FIG. 16, if the thermal paper roll 10 is disposed in a predetermined direction and is installed in the roll tray 50, the first and second loading direction identification surfaces 36 and 37 are appropriately accommodated in the first and second lateral surface accommodating portions 53 and 54 (the upper view of FIG. 16). On the other hand, if the thermal paper roll 10 is disposed in a direction reverse to the predetermined direction and is to be installed in the roll tray 50, the first loading direction identification surface 36 is accommodated in the second lateral surface accommodating portion 54 but the second loading direction identification surface 37 is not accommodated in the first lateral surface accommodating portion 53 (lower view of FIG. 16). Therefore, it is possible to prevent the thermal paper 12 from being installed in a wrong direction via the loading direction identification surfaces 36 and 37.

According to this embodiment, it is possible to prevent the thermal paper 12 from being installed in an erroneous direction with a simple configuration by identifying the loading direction of the thermal paper roll 10 via the contacted surface 30 provided in the thermal paper roll 10.

5. Fourth Embodiment

Next, a fourth embodiment of the present disclosure will be described with reference to FIGS. 17 to 19. In the fourth embodiment, unlike in the other embodiments, a flange 27 is attached to only one end surface of the paper core 11. In addition, the contacted surface 30 is formed on the flange 27 by any one described in the first to third embodiments.

Figure 17:
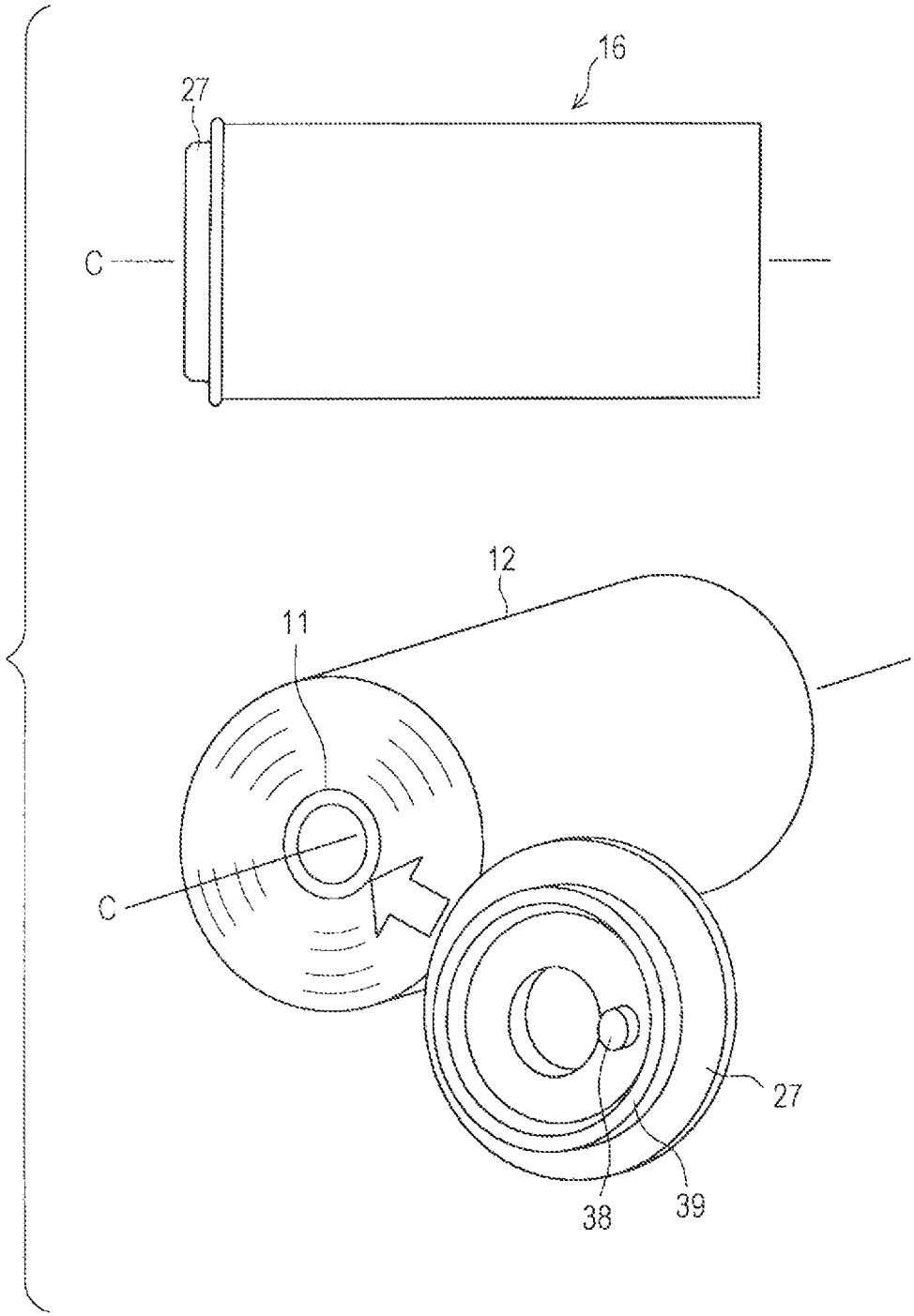
FIG. 17 is a diagram illustrating a configuration of a thermal paper roll according to a fourth embodiment.

FIG. 17 shows a configuration of the thermal paper roll 10 according to the fourth embodiment. As shown in FIG. 17, the thermal paper roll 10 has the paper core 11, the thermal paper 12, the flange 27, and the contacted surface 30 including contacted surfaces 38 and 39. Here, the flange 27 is attached to only one end surface of the paper core 11.

On one surface of the flange 27, the contacted surface 30 is formed on a plane intersecting the roll axis C of the paper core 11 at the opposite side to the paper core 11 in a state where the flange 27 is attached to the paper core 11. In FIG. 17, a boss-shaped convex surface which is the rotation state detection surface 38 and a circular convex surface which is the loading state detection surface 39, are formed on the flange 27.

Figure 18:
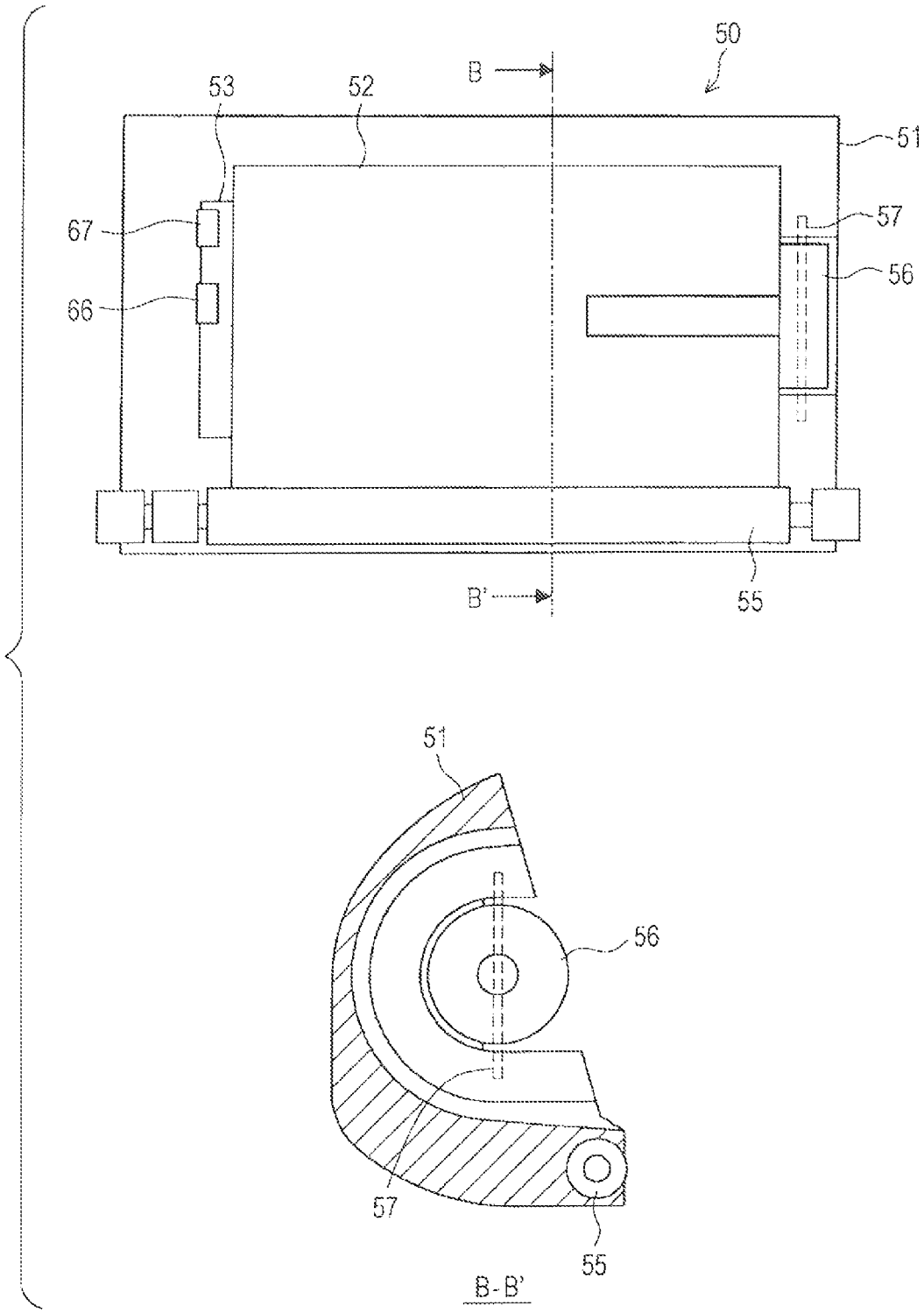
FIG. 18 shows a plan view and a cross-sectional view of a roll tray which is loaded with the thermal paper roll.

FIG. 18 shows the roll tray 50 which is loaded with the thermal paper roll 10. As shown in FIG. 18, as in the first embodiment, the roll tray 50 is provided with the accommodating portions including the center accommodating portion 52 and the lateral surface accommodating portion 53, and the contact sensor 60 for detecting a state of the thermal paper roll 10 via the contacted surface 30.

Here, the lateral surface accommodating portion 53 is provided at one side of the center accommodating portion 52, that is, only the side where the flange 27 is accommodated. A rotation state detection sensor 66 for detecting a rotation state of the thermal paper roll 10 and a loading state detection sensor 67 for detecting a loading state of the thermal paper roll 10 are provided at the lateral surface of the lateral surface accommodating portion 53.

On the other hand, a paper core holding axis 56 is provided on a part of the casing 51 at the other side of the center accommodating portion 52. The paper core holding axis 56 is a tubular or axial member for supporting the paper core 11 of the thermal paper roll 10 installed in the roll tray 50. The paper core holding axis 56 is provided in the casing 51 so as to be tilted with respect to the center accommodating portion 52 via a tilt axis 57 (refer to the cross-sectional view).

Figure 19:
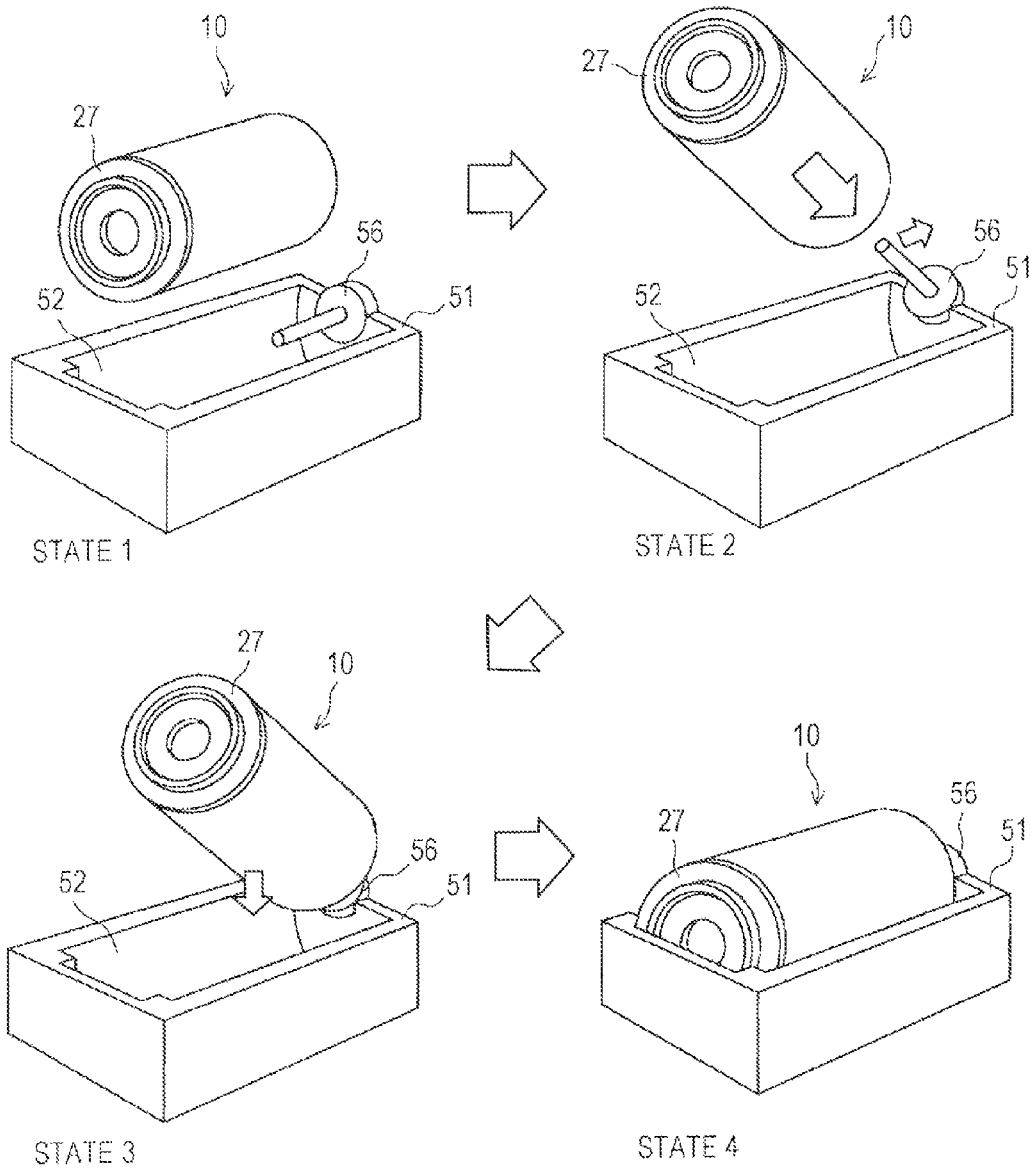
FIG. 19 is a diagram illustrating loading procedures of the thermal paper roll.

FIG. 19 shows loading procedures of the thermal paper roll 10. As shown in FIG. 19, first, the thermal paper roll 10 is prepared in which the flange 27 is attached to the one end surface of the paper core 11 (state 1). Next, in order to insert the paper core holding axis 56 into the paper core 11, the paper core holding axis 56 is tilted to form elevation with respect to the center accommodating portion 52 (state 2). Thereafter, the paper core holding axis 56 is inserted into the paper core 11 from the end surface opposite to the attached surface of the flange 27 (state 3). Next, in order to install the thermal paper roll 10 in the roll tray 50, the paper core holding axis 56 inserted into the paper core 11 leans toward the center accommodating portion 52 side along with the paper core 11 (state 4).

The central portion of the thermal paper roll 10 is accommodated in the center accommodating portion 52, and the lateral surface portion of the thermal paper roll 10 is accommodated in the lateral surface accommodating portion 53. In addition, the thermal paper roll 10 is installed in the roll tray 50 such that at least the loading state detection sensor 67 faces the loading state detection surface 39 of the thermal paper roll 10 at all times.

According to this embodiment, by providing the mechanism holding the thermal paper roll 10 in the roll tray 50, the flange 27 is attached to only the one end surface of the thermal paper roll 10, and a roll type of the thermal paper roll 10 can be detected via the contacted surface 30 formed on the flange 27.

In addition, in this embodiment, instead of detecting a rotation state and a loading state of the thermal paper roll 10, the roll type (two kinds) may be detected, or the loading direction may be identified.

Although the preferred embodiments of the present disclosure have been described with reference to the accompanying drawings, the present disclosure is not limited to the embodiments. It is understood by those skilled in the art that various modifications and alterations apparently occur within the scope of the appended claims, and they are naturally included in the technical scope of the present disclosure.

For example, in the above description, by using the contacted surface 30 formed on the flange 20, the case of detecting a rotation state and a loading state of the thermal paper roll 10, the case of detecting a roll type, and the case of identifying a loading direction have been described. However, in the above-described embodiments, for example, there may be an arbitrary combination such as detection of a roll type along with a rotation state and a loading state of the thermal paper roll 10.

In addition, in the above description, the case where a state of the contacted surface 30 which is a convex surface or a planarized surface is detected by the contact sensor 60 has been described. However, there may be a configuration in which a state of the contacted surface 30 which is a convex surface or a concave surface, or a planarized surface or a concave surface is detected by the contact sensor 60.

Further, in an image forming method according to an embodiment of the present disclosure, a part thereof may be performed using a software configuration. In this case, the image forming method is performed by a program executed on a processor which functions as the printer control unit 77 or the like.

The present disclosure contains subject matter related to that disclosed in Japanese Priority Patent Application JP 2010-196648 filed in the Japan Patent Office on Sep. 2, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal paper roll comprising:

a paper core;

a thermal paper wound on the paper core;

a flange attached to at least one end surface of the paper core; and a contacted surface formed on a plane intersecting a roll axis of the paper core at a side opposite to the paper core side of the flange in order to detect or identify a state of the thermal paper roll.

2. The thermal paper roil according to claim 1, wherein the contacted surface is formed as a convex surface or a concave surface for detecting a rotation state of the thermal paper roll.

3. The thermal paper roll according to claim 1, wherein the contacted surface is formed as a convex surface or a concave surface for detecting a loading state of the thermal paper roll.

4. The thermal paper roll according to claim 1, wherein the contacted surface is formed as a convex surface or a concave surface for detecting a roll type of the thermal paper roll.

5. The thermal paper roll according to claim 1, wherein the contacted surface is formed as a convex surface or a concave surface for identifying a loading direction of the thermal paper roll.

6. An image forming device comprising:

a roll loading portion loaded with a thermal paper roll;

a state detection portion detecting a state of a contacted surface provided in the thermal paper roll; and a control portion performing a predetermined control according to the state of the thermal paper roll detected via the contacted surface, wherein the thermal paper roll includes, a paper core;

a thermal paper wound on the paper core;

a flange attached to at least one end surface of the paper core; and the contacted surface formed on a plane intersecting a roll axis of the paper core at a side opposite to the paper core side of the flange in order to detect a state of the thermal paper roll.

7. The image forming device according to claim 6, wherein the control portion performs a predetermined control according to a rotation state of the thermal paper roll detected via the contacted surface.

8. The image forming device according to claim 6, wherein the control portion performs a predetermined control according to a loading state of the thermal paper roll detected via the contacted surface.

9. The image forming device according to claim 6, wherein the control portion performs a predetermined control according to a roll type of the thermal paper roll detected via the contacted surface.

10. The image forming device according to claim 6, wherein the roll loading portion is provided with a lateral surface accommodating portion which holds the thermal paper roll to rotate about the roll axis via the flange attached to both end surfaces of the paper core.

11. The image forming device according to claim 6, wherein the flange is attached to only one end surface of the paper core, and wherein the roll loading portion is provided with a paper core holding axis which is inserted into the other end surface of the paper core, in order to hold the thermal paper roll so as to rotate about the roll axis.

12. An image forming method comprising:

detecting a state of a contacted surface provided in a thermal paper roll having a paper core, thermal paper wound on the paper core, a flange attached to at least one end surface of the paper core, and, the contacted surface formed on a plane intersecting a roll axis of the paper core at a side opposite to the paper core side of the flange in order to detect a state of the thermal paper roll; and performing a predetermined control according to the state of the thermal paper roll detected via the contacted surface.

13. A program embodied on a non-transitory computer readable medium causing a computer to execute an image forming method comprising the steps of:

detecting a state of a contacted surface provided in a thermal paper roll having a paper core, thermal paper wound on the paper core, a flange attached to at least one end surface of the paper core, and, the contacted surface formed on a plane intersecting a roll axis of the paper core at a side opposite to the paper core side of the flange in order to detect a state of the thermal paper roll; and performing a predetermined control according to the state of the thermal paper roll detected via the contacted surface.

* * * * *